US009126216B2

(12) United States Patent
Scott et al.

(10) Patent No.: US 9,126,216 B2
(45) Date of Patent: Sep. 8, 2015

(54) CORE STRIPING MECHANISM

(75) Inventors: Craig Scott, Lancaster, CA (US); Joseph Giannone, Lancaster, CA (US); Christopher R. Wirz, Lancaster, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 690 days.

(21) Appl. No.: 13/163,484

(22) Filed: Jun. 17, 2011

(65) Prior Publication Data

US 2012/0321800 A1 Dec. 20, 2012

(51) Int. Cl.

| | |
|---|---|
| ***B05C 13/02*** | (2006.01) |
| ***B05B 3/00*** | (2006.01) |
| ***B05B 7/06*** | (2006.01) |
| ***B05B 13/02*** | (2006.01) |
| ***B05C 11/06*** | (2006.01) |
| *B05B 15/04* | (2006.01) |

(52) U.S. Cl.

CPC ..... *B05B 13/02* (2013.01); *B05C 11/06* (2013.01); *B05B 15/0406* (2013.01)

(58) Field of Classification Search

CPC ..... B05B 13/04; B05B 13/041
USPC ..... 118/305, 325, 323, 500, 313–315, 286; 427/286

See application file for complete search history.

(56) References Cited

U.S. PATENT DOCUMENTS

| | | | | |
|---|---|---|---|---|
| 4,038,939 | A * | 8/1977 | Hoyer et al. | 118/665 |
| 4,208,454 | A * | 6/1980 | Reed et al. | 427/238 |
| 5,480,729 | A | 1/1996 | Hattori et al. | |
| 5,501,148 | A | 3/1996 | Bellio et al. | |
| 5,686,145 | A | 11/1997 | Akasaka | |
| 5,800,614 | A * | 9/1998 | Foust | 118/315 |
| 6,665,949 | B1 | 12/2003 | Reis et al. | |
| 6,736,180 | B2 | 5/2004 | Anderson et al. | |
| 6,737,115 | B2 | 5/2004 | Griesbach | |
| 6,895,689 | B2 | 5/2005 | Ueno | |
| 2006/0048705 | A1 | 3/2006 | Colin et al. | |
| 2008/0069717 | A1 | 3/2008 | Inaguma et al. | |
| 2009/0110829 | A1 | 4/2009 | Johnson et al. | |

FOREIGN PATENT DOCUMENTS

| | | |
|---|---|---|
| DE | 102007034544 | 1/2009 |
| JP | 62254878 | 11/1987 |
| JP | 08031550 | 2/1996 |

OTHER PUBLICATIONS

Hay et al., "Mobile Zone Spray Booth Recirculation System", US Army Corps of Engineers, Mar. 2005.

* cited by examiner

*Primary Examiner* — Yewebdar Tadesse
(74) *Attorney, Agent, or Firm* — McDermott Will & Emery LLP

(57) ABSTRACT

A system for creating a reference mark on a honeycomb core is disclosed. The core has cells that pass from a top face to a bottom face. The system includes a support surface configured to position the honeycomb core, a mounting plate configured to move along a defined path proximate to the top surface of the honeycomb core when positioned on the support surface, and a first nozzle coupled to the mounting plate. The first nozzle is configured to apply a marking material to a portion of the top face of the honeycomb core as the mounting plate passes along the defined path.

15 Claims, 2 Drawing Sheets

CORE STRIPING MECHANISM

CROSS-REFERENCE TO RELATED APPLICATIONS

Not applicable.

STATEMENT REGARDING FEDERALLY SPONSORED RESEARCH OR DEVELOPMENT

Not applicable

BACKGROUND

1. Field

The present disclosure generally relates to fabrication of honeycomb structures and, in particular, the process of creating a reference mark on a honeycomb core.

2. Description of the Related Art

Aerospace structures must meet stringent requirements for strength while also having low weight. One design approach that is utilized in structures such as aircraft wings is a composite assembly having a honeycomb core with rigid skins bonded to both faces of the core. This composite structure makes maximal utilization of the strength properties of the skin material while utilizing a lightweight interior material with adequate strength to meet the service requirements.

A typical step in the fabrication of a composite structure with a honeycomb core is to create a reference mark across the honeycomb core. It is often desirable that this reference mark extend through the thickness of a core.

Current methods of creating a reference mark include the placement of parallel lines of masking tape on each side of the intended location of the reference mark. A paint is poured between the two lines. After pouring is complete, the operator uses a squeegee to level the coating of paint and remove excess paint. This process is labor intensive and it may take 15 minutes or more to create a single reference line on a honeycomb core. The current process is also dependent upon the skill of the operator that applies the tape and paint, as the straightness of the line is an entirely manual operation.

SUMMARY

There is a need to provide a system and method to create a reference mark across the face of a honeycomb core using less labor and material than the current manual process. The disclosed system and method provide an automated system that applies a marking material along a defined path across the face of a honeycomb core.

The disclosed system includes a support table that positions the honeycomb core in a repeatable position. A mounting plate slides along a pair of guide rails that are positioned above the honeycomb core. Attached to the mounting plate is a paint applicator that applies paint to the honeycomb through a nozzle. As the mounting plate passes along the guide rails, the applicator creates a stripe beneath the path of the nozzle. An air nozzle is positioned adjacent to the paint nozzle. The air nozzle directs pressurized air onto the freshly applied paint, blowing the excess paint through the cells of the honeycomb core and promoting the drying of the paint. The excess paint collects in a trough in the surface of the support table.

In certain embodiments, a system for creating a reference marking through a thickness of a honeycomb core having cells that pass from a top face through the thickness to a bottom face is disclosed. The system includes a support surface that is configured to position the honeycomb core, a mounting plate configured to move along a defined path proximate to the top surface of the honeycomb core when positioned on the support surface, and a first nozzle coupled to the mounting plate. The first nozzle is configured to apply a marking material to a portion of the top face of the honeycomb core as the mounting plate passes along the axis.

In certain embodiments, a method of creating a reference marking through a thickness of a honeycomb core having a top face and a bottom face is disclosed. The method includes the steps of passing a first nozzle along a path over the top face of the honeycomb core while dispensing a marking material from the first nozzle, and passing a second nozzle along the same path as the first nozzle while blowing air from the second nozzle sufficient to distribute the dispensed marking material through the thickness of the honeycomb core and force the excess marking material out of the bottom face.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

Fabrication of honeycomb structures requires a significant amount of manual handling. Honeycomb core, prior to being bonded to skins or other structures, is very flexible. Reference marks must be created on the honeycomb core to provide a reference for sequential fabrication operation such as machining and bonding.

In the following detailed description, numerous specific details are set forth to provide a full understanding of the present disclosure. It will be apparent, however, to one ordinarily skilled in the art that embodiments of the present disclosure may be practiced without some of the specific details. In other instances, well-known structures and techniques have not been shown in detail so as not to obscure the disclosure.

The methods and systems disclosed herein are presented in terms of creating a straight reference stripe across the face a honeycomb core using paint and penetrating through the thickness of the honeycomb core. These same methods and systems can be applied to other structures, such as sheet metal or woven mesh, using other marking materials, such as ink or dye. Nothing in this disclosure should be interpreted, unless specifically stated as such, to limit the application of any claimed method or system disclosed herein to honeycomb structures or straight reference lines.

Figure 1:
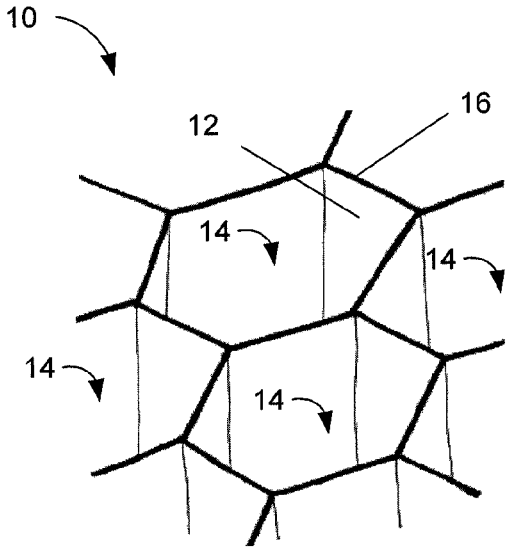
FIG. 1 depicts a face of a honeycomb core.

FIG. 1 depicts a face of a honeycomb core 10. In this example, the honeycomb core 10 is a series of adjacent hexagonal cells 14 separated by walls 12. The cut surface of the honeycomb core 10 forms a face. Honeycomb cores 10 are typically provided as sheets of a uniform thickness with the cells 14 running from a top face 16 to a bottom face (not visible in FIG. 1) through the thickness of the honeycomb core 10. Honeycomb cores used in aerospace structures can have cells with a width, defined as the distance between opposite flat surfaces, of 0.25 inches or less. Honeycomb cores used in other products, for example doors, may have cell widths of an inch or greater.

Figure 2:
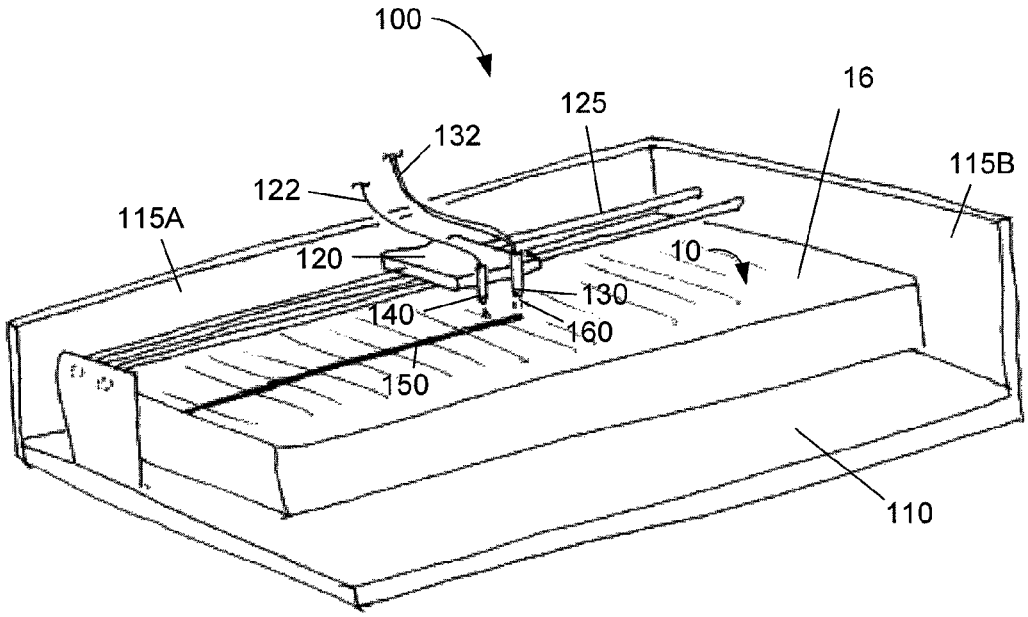
FIG. 2 depicts an exemplary embodiment of a core striping system according to certain aspects of this disclosure.

FIG. 2 depicts an exemplary embodiment of a core striping system 100 according to certain aspects of this disclosure. In this embodiment, a support surface 110 is flat and horizontal with attached alignment features 115A and 115B that are, in this embodiment, flat vertical surfaces that are perpendicular to the support surface 110 and to each other. In this embodiment, a pair of guide rails 125 is positioned over the support surface 110 and run parallel to alignment feature 115A. In certain embodiments, the guide rails 125 can be repositioned at various distances from alignment feature 115A. In certain embodiments, the guide rails can be repositioned to be parallel to alignment feature 115B at various distances. In certain embodiments, the position of the guide rails 125 are fixed relative to the support surface 110 and the alignment features 115A, 115B are repositionable to locate the desired location of the reference mark 150 under the path of the guide rails 125.

FIG. 2 depicts a mounting plate 120 that is slidably coupled to the guide rails 125. In this embodiment, the mounting plate 120 can move along the guide rails 125 at a controlled speed over the entire length of the support surface 110. In certain embodiments, the guide rails 125 are a pair of straight parallel cylindrical rods. In certain embodiments, one rail provides two-axis control, i.e. vertical and horizontal, while the second rail provides only vertical control. In certain embodiments, the guide rails 125 are track rails adapted for use with wheeled devices. In certain embodiments, the guide rails 125 are curved (not shown) in the plane of the support surface 110. In certain embodiments, the guide rails 125 are curved in the vertical plane (not shown) such that the nozzles 130, 140 are maintained at a constant distance from a curved face 16. Other means of providing guide rails 125 for a moving support plate 120 will be known to those of skill in the art.

In certain embodiments, the mounting plate 120 includes ball bearings (not shown) that contact the guide rails 125. In certain embodiments, the mounting plate 120 includes bushings (not shown) that are in contact with the guide rails 125. In certain embodiments, the mounting plate 120 includes air bearings (not shown) that are in contact with the guide rails 125. In certain embodiments, a drive system (not shown) is coupled between the mounting plate 120 and the support surface 110 to drive the mounting plate 120 along the guide rails 125. In certain embodiments, the drive system is a belt or cable (not shown) attached at one end to the support plate 120 and wrapped around a drive spool (not shown) at the other end. In certain embodiments, a linear actuator (not shown) is coupled between the mounting plate 120 and the support surface 110. Other means of providing a controlled movement of the mounting plate along the guide rails 125 will be known to those of skill in the art.

In the embodiment of FIG. 2, a first nozzle 130 is coupled to the mounting plate 120. In certain embodiments, this coupling is accomplished by a positionable arm (not shown). In certain embodiments, the first nozzle 130 is oriented such that the application nozzle points orthogonally to the support surface 110. In this embodiment, the first nozzle 130 is fluidically coupled through line 132 to a paint reservoir (not shown). In certain embodiments, a small paint reservoir (not shown) is mounted directly to the first nozzle 130. A small reservoir mounted at or near the nozzle 130 allows the use of a small quantity of paint without requiring additional paint to prime the line 132.

FIG. 2 also depicts a second nozzle 140 coupled to the mounting plate 120. The second nozzle is fluidically coupled through line 122 to a source (not shown) of clean, compressed gas. In certain embodiments, line 122 is connected to a source of compressed air. The second nozzle 140 is also coupled to the mounting plate 120, in certain embodiments, using a positionable arm (not shown). In certain embodiments, a small container (not shown) of compressed gas is located on the mounting plate 120 and connected directly to the second nozzle. The use of a small container eliminates the complexity of having an air line moving over the core striping system 100 and affecting the motion of the mounting plate 120.

FIG. 2 illustrates the core striping system 100 in the middle of a striping operation. In use, a rectangular block of honeycomb core 10 is placed on the support surface 110 with the top face 16 on the upper side such that the cells 14 run from top to bottom. The honeycomb core 10 is slid across the support surface 110 into the alignment features 115A, 115B, thereby positioning the honeycomb core 10. The position of the alignment features 115A and 115B may be adjusted to properly position the honeycomb core 10 on the support surface 110. In certain embodiments, the guide rails 125 are movable and the position of the guide rails 125 is adjusted relative to the support surface 110. The first nozzle 130 is positioned over the face 16 of the honeycomb core 10 and is shown in FIG. 2 applying a quantity of marking material 160, with reference to FIG. 3, to the honeycomb core 10 as the mounting plate 120 is sliding from left to right, in the view of FIG. 2. The second nozzle 140 has been positioned to direct a flow of air onto the freshly applied marking material 160 applied by first nozzle 130 as the mounting plate 120 moves over the face 16 of the honeycomb core 10. The application of the marking material 160 and flow of air are discussed in greater detail with respect to FIG. 3.

In certain embodiments, the operator may chose to 'repaint the line,' i.e. apply a second quantity of the marking material 160 over the first stripe 150 of marking material, to make stripe 150 more conspicuous before applying the finish/drying air. In certain embodiments, different material types of honeycomb core 10 are striped with the same system 100. Material 'A' may require only 1 pass. Material may require 2 passes due to adhesion, surface finish, or retention characteristics of the resin that forms part of the walls 12 of the honeycomb core 10.

Figure 3:
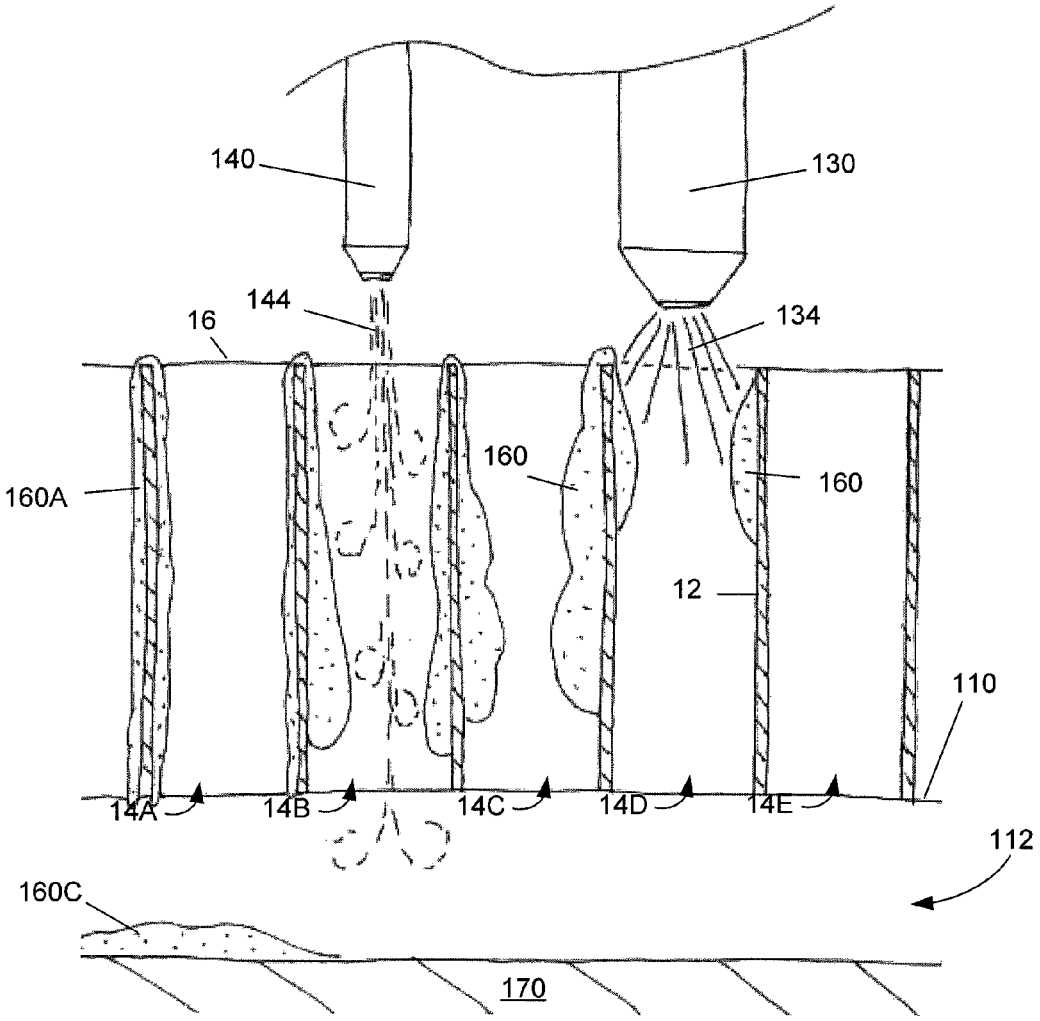
FIG. 3 is an enlarged cross-section of the paint and air nozzles positioned over the honeycomb core according to certain aspects of this disclosure.

As can be seen in FIG. 2, there is no need to apply tape to the face 16 of the honeycomb core 10. The paint stripe 150 applied by the first nozzle 130 is the desired width with little overspray. There is no need for leveling or removal of excess paint 160 by the operator as the second nozzle 140 forces the excess material 160 through the cells 14 and out into the trough 112, as seen in FIG. 3. A reference mark 150 can be applied to a typical honeycomb core 10 in about 2 minutes, compared to 15 minutes using the manual method, and produces less waste, i.e. used tape and wasted paint, than the manual process.

FIG. 3 is an enlarged cross-section of the paint and air nozzles 130, 140 positioned over the honeycomb core 10 according to certain aspects of this disclosure. The cross-section has been taken through the honeycomb core 10 and the support surface 110 along the intended location of the reference mark 150. There is a collection trough 112 located in the support surface 110 along the line of the cross-section. The cross-section of the honeycomb core 10 reveals a plurality of cells 14A, 14B, 14C, 4D, and 14E separated by walls 12 with the top face 16 on the upper side of the honeycomb core 10.

The first nozzle 130 is positioned over the face 16 and dispensing a spray 134 of a marking material 160 as the first nozzles moves over the honeycomb core 10 from left to right, in the view of FIG. 3. The marking material 160 accumulates on the walls 12 of the cells 14 near the top face 16, as shown for cells 14D and 14C. The second nozzle 140 is positioned to follow the path of the first nozzle 130. The second nozzle 140 is directing a jet 144 of compressed air into the cells 14 underneath, as shown for cell 14B. It can be seen that the jet 144 is forcing the applied marking material 160 down the walls of cell 14B. As the lower face of the honeycomb core is over the trough 112 and therefore open, the air of jet 144 passes out of the cell 14B into the trough 112, carrying the excess marking material 160 with it. As can be seen in cell 14A, a thin coating 160A of marking material 160 is left on at least a portion of the walls 12 of cells 14. In certain embodiments, the thin coating 160A covers most of the walls 12 of cells 14. The thin coating of marking material 160A in cell 14A will dry faster than the thick coating of marking material 160 shown in cell 14C. The excess material 160C collects in the trough 112.

The concepts disclosed herein provide a system and method for creating a reference mark on the face of a honeycomb core without the need for tape or leveling of the applied paint or manual removal of excess paint or other marking material. The system includes a support surface with a trough in the surface under the intended location of the reference mark. The system also has a mounting plate that slides along guide rails over the support surface. The mounting plate carries a paint application nozzle and an air nozzle arranged so the air is directed onto the fleshly applied paint as the mounting plate slides along the guide rails. Excess paint is forced through the cells of the honeycomb core and expelled into the trough. The jet of air also assists in drying the applied paint.

The previous description is provided to enable a person of ordinary skill in the art to practice the various aspects described herein. While the foregoing has described what are considered to be the best mode and/or other examples, it is understood that various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the terms "a set" and "some" refer to one or more. Pronouns in the masculine (e.g., his) include the feminine and neuter gender (e.g., her and its) and vice versa. Headings and subheadings, if any, are used for convenience only and do not limit the invention.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A system for creating a reference mark on a honeycomb core having cells that pass from a top face to a bottom face, the system comprising:

a support surface configured to position the honeycomb core;

alignment features configured to reproducibly position the honeycomb core, the honeycomb core being in contact with the support surface and each of the alignment features, the alignment features comprising first and second surfaces perpendicular to the support surface and to each other;

a mounting plate configured to move along a defined path proximate to the top face of the honeycomb core when positioned on the support surface; and a first nozzle coupled to the mounting plate, the first nozzle configured to apply a marking material to a portion of the top face of the honeycomb core as the mounting plate passes along the defined path.

2. The system of claim 1, wherein the defined path is a straight line.

3. The system of claim 2, further comprising a linear track coupled to the support surface, wherein the mounting plate is slidably coupled to the linear track.

4. The system of claim 3, further comprising an actuator coupled to the mounting plate, the actuator configured to selectably move the mounting plate along the linear track at a constant speed.

5. The system of claim 4, wherein the first nozzle and the actuator are coupled to each other and configured to apply the marking material at a constant rate as the mounting plate moves along the linear track.

6. The system of claim 1, wherein the first nozzle is aligned approximately perpendicular to the top face of the honeycomb core.

7. The system of claim 1, further comprising a second nozzle coupled to the mounting plate, the second nozzle configured to blow air onto the applied marking material so as to force a portion of the marking material through the cells of the honeycomb.

8. The system of claim 7, wherein the second nozzle is aligned approximately perpendicular to the top face of the honeycomb core.

9. The system of claim 7, wherein the first and second nozzles are configured to cooperatively coat at least a portion of the cells and to force excess marking material out of the bottom face.

10. The system of claim 9, wherein the support surface comprises a trough configured to capture the excess marking material forced out of the bottom face of the honeycomb core, the trough extending below the honeycomb core such that, when the honeycomb core is positioned on the support surface, captured excess marking material is spaced from the bottom face of the honeycomb core.

11. The system of claim 1, wherein the portion of the top face of the honeycomb core is a stripe having a constant width.

12. The system of claim 11, wherein the width of the stripe is less than 1 centimeter.

13. The system of claim 12, wherein of the stripe is less than 0.3 centimeter.

14. The system of claim 1, wherein the first nozzle is configured to apply paint to the honeycomb core.

15. The system of claim 1, wherein the honeycomb core comprises a plurality of sheets.

* * * * *